US011517098B2

(12) United States Patent
Nolan et al.

(10) Patent No.: US 11,517,098 B2
(45) Date of Patent: Dec. 6, 2022

(54) DISPENSER WITH REPLACEABLE MATERIAL

(71) Applicants: Michael P. Nolan, Long Beach, NY (US); John T. Morrisey, Maspeth, NY (US)

(72) Inventors: Michael P. Nolan, Long Beach, NY (US); John T. Morrisey, Maspeth, NY (US); Kevin P. Hardin, San Diego, CA (US)

( * ) Notice: Subject to any disclaimer, the term of this patent is extended or adjusted under 35 U.S.C. 154(b) by 628 days.

(21) Appl. No.: 16/677,659

(22) Filed: Nov. 7, 2019

(65) Prior Publication Data

US 2021/0137243 A1 May 13, 2021

(51) Int. Cl.

| | |
|---|---|
| ***A45D 40/16*** | (2006.01) |
| ***A45D 40/04*** | (2006.01) |
| ***B65D 83/00*** | (2006.01) |
| ***A45D 40/14*** | (2006.01) |
| ***A45D 40/06*** | (2006.01) |
| *A45D 40/00* | (2006.01) |

(52) U.S. Cl.

CPC ..... *A45D 40/16* (2013.01); *A45D 40/04* (2013.01); *A45D 40/06* (2013.01); *A45D 40/065* (2013.01); *A45D 40/14* (2013.01); *B65D 83/0011* (2013.01); *A45D 2040/0043* (2013.01); *A45D 2040/0056* (2013.01); *A45D 2040/0062* (2013.01)

(58) Field of Classification Search

CPC ..... A45D 40/04; A45D 40/06; A45D 40/065; A45D 40/14; A45D 40/16; A45D 2040/0043; A45D 2040/0056; A45D 2040/0062; B65D 83/0011

See application file for complete search history.

(56) References Cited

U.S. PATENT DOCUMENTS

| | | | |
|---|---|---|---|
| 2,789,692 | A | 4/1957 | Ferri |
| 3,214,012 | A | 10/1965 | Mack |
| 3,771,881 | A | 11/1973 | Swenson |
| 4,232,977 | A | 11/1980 | Chutter |

(Continued)

FOREIGN PATENT DOCUMENTS

| | | | | |
|---|---|---|---|---|
| FR | 1377658 | A | 12/1963 | |
| FR | 2833816 | A1 * | 6/2003 | ..... A45D 40/04 |

OTHER PUBLICATIONS

English machine translation of Foreign Patent Document FR1377658A, dated Jun. 13, 2019.

(Continued)

*Primary Examiner* — Jennifer C Chiang
(74) *Attorney, Agent, or Firm* — Ido Tuchman

(57) ABSTRACT

A refillable dispenser including a casing and a platform for receiving consumable material. A knob rotatably mounted at a bottom end of the dispenser is mechanically coupled to the platform such that rotating the knob moves the platform up or down within the dispenser. Gripping arms connected to the platform are configured to flex toward a longitudinal axis and engage the consumable material when the platform is away from a top travel position such that the consumable material is secured to the platform. The gripping arms are configured to flex away from the longitudinal axis and release the consumable material from the platform when the platform is at the top travel position.

20 Claims, 10 Drawing Sheets

(56) References Cited

U.S. PATENT DOCUMENTS

| | | | | |
|---|---|---|---|---|
| 5,505,041 | A | 4/1996 | Harlan | |
| 6,030,136 | A | 2/2000 | Bennett | |
| 6,086,276 | A | 7/2000 | Gueret | |
| 9,723,907 | B2 | 8/2017 | Huang | |
| 10,278,473 | B2 | 5/2019 | Groffsky | |
| 2022/0000246 | A1* | 1/2022 | Trochel | A45D 40/16 |
| 2022/0053914 | A1* | 2/2022 | Figueiredo | A45D 40/16 |
| 2022/0232947 | A1* | 7/2022 | Morales | A45D 40/16 |

OTHER PUBLICATIONS https://www.helmm.com/, pp. 1-13 (Jun. 12, 2019).
https://isabellabarrosmartins.wordpress.com/2019/02/21/loja-oferece-assinatura-de-itens-com-embalagem-de-fibra-natural/, pp. 1-4 (Jun. 12, 2019).
English machine translation of https://isabellabarrosmartins.wordpress.com/2019/02/21/loja-oferece-assinatura-de-tens-com-embalagem-de-fibra-natural/, pp. 1-4 (Jun. 12, 2019).
https://www.mymyro.com/pages/deodorant, pp. 1-9 (Jun. 12, 2019).

* cited by examiner

DISPENSER WITH REPLACEABLE MATERIAL

BACKGROUND

The present invention is directed toward product dispensers with replaceable consumable materials, such as deodorant dispenser with replaceable deodorant pods.

Single-use, disposable deodorant dispensers are well known and widely used. These dispensers often incorporate a solid deodorant stick or pod that is movable vertically relative to a dispenser opening. The deodorant material is moved past the dispenser opening and is applied to the underarm.

As the deodorant stick is consumed, more of the deodorant stick is mechanically shifted past the dispenser opening. Once the deodorant stick in the dispenser is depleted, the empty dispenser is usually disposed and a new dispenser with an included deodorant stick is purchased.

A drawback of single-use dispensers is their environmental impact. These dispensers require energy to manufacture and their production can create pollution and greenhouse gases. Disposal of single-use dispensers consumes waste treatment resources, such as waste collection resources, landfill resources, and recycling resources.

BRIEF SUMMARY

Accordingly, aspects of the present invention include a more environmentally friendly and reusable dispenser for dispensing consumable material. The dispenser includes a casing that extends from a bottom end to a top end and defines a longitudinal axis. A platform is positioned within the casing and is adapted to receive the consumable material.

The platform is movable along the longitudinal axis in a distal direction and a proximal direction. The distal direction is from a top travel position proximate the top end to a bottom travel position proximate the bottom end. The proximal direction is from the bottom travel position to the top travel position.

The dispenser further includes a plurality of retaining clips connected to the platform. Each retaining clip includes a gripping arm configured to flex toward the longitudinal axis and engage the consumable material when the platform is away from the top travel position such that the consumable material is secured to the platform. The gripping arm is configured to flex away from the longitudinal axis and release the consumable material from the platform when the platform is at the top travel position.

A knob is rotatably mounted at the bottom end of the casing. The knob is mechanically coupled to the platform such that rotating the knob in a first direction moves the platform in the distal direction and rotating the knob in a second direction moves the platform in the proximal direction.

Another example aspect of the present invention is a refillable deodorant applicator with a deodorant product. The deodorant applicator includes a cylindrical casing enclosing the deodorant product and defining a longitudinal axis. The cylindrical casing includes a base and a sidewall extending from the base to a top end A platform adapted to receive the deodorant product is positioned within the casing. The platform is movable along the longitudinal axis in a distal direction from a top travel position near the top end to a bottom travel position, and a proximal direction from the bottom travel position to the top travel position.

The deodorant applicator includes a plurality of retaining clips connected to the platform. Each of the retaining clips includes a gripping arm configured to flex toward the longitudinal axis and engage the deodorant product when the platform is away from the top travel position such that the deodorant product is secured to the platform. The gripping arm is further configured to flex away from the longitudinal axis and release the deodorant product from the platform when the platform is at the top travel position.

A knob is rotatably mounted at the base and is mechanically coupled to the platform. Rotating the knob in a first direction moves the platform in the distal direction and rotating the knob in a second direction moves the platform in the proximal direction.

Yet another example aspect of the present invention is a deodorant pod including an elliptical base and a cylindrical body. The elliptical base defines a major axis and a minor axis. The cylindrical body rises from the base and defines a first channel and a second channel at opposite ends of the major axis. The first channel and the second channel are each configured to receive a respective gripping arm and to releasably secure the deodorant stick to a dispensing platform.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

Figure 1:
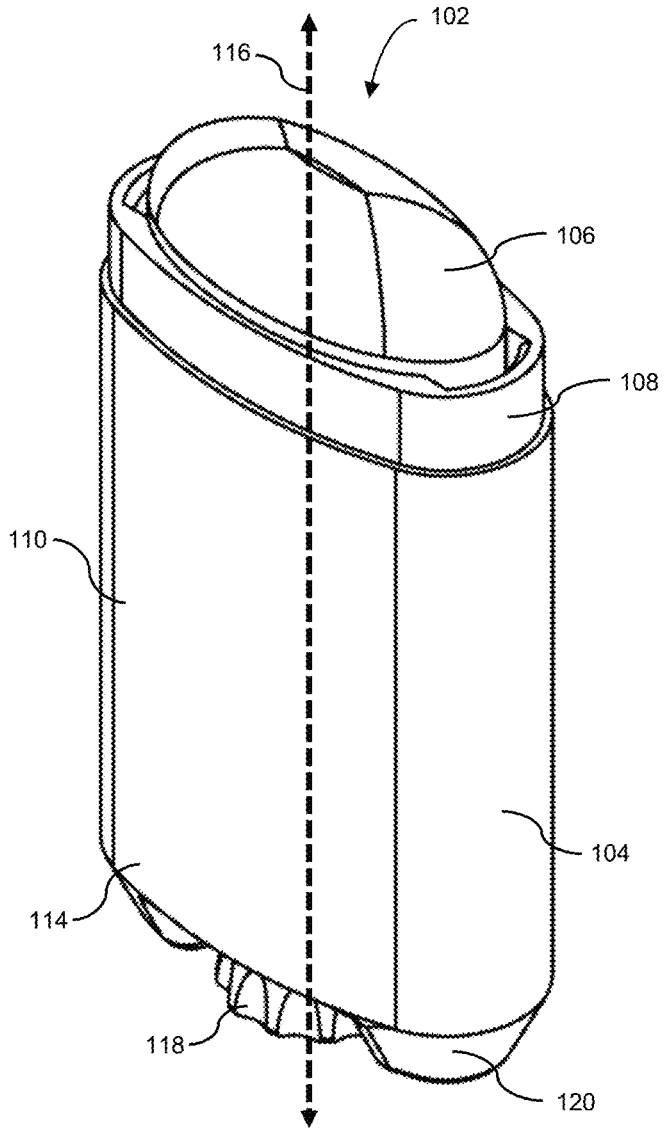
FIG. 1 shows an example dispenser contemplated by the present invention.

The present invention is described with reference to embodiments of the invention. Throughout the description of the invention reference is made to FIGS. 1-10. When referring to the figures, like structures and elements shown throughout are indicated with like reference numerals.

FIG. 1 shows one embodiment of a dispenser 102 contemplated by the present invention. The dispenser 102 includes a cylindrical casing 104 housing consumable material 106. The casing 104 is made from a rigid material, such as metal or plastic, protecting the consumable material 106 from the environment. In one embodiment, the casing 104 is manufactured from injection molded plastic. Plastic materials for manufacturing the dispenser 102 include, but are not limited to, polyethylene terephthalate (PET) and acrylonitrile butadiene styrene and similar material variants. Metal materials for manufacturing the dispenser 102 include, but are not limited to, machined stainless steel and aluminum. The dispenser 102 may include a closed-ended cap (not shown) configured to snap or friction fit onto a top end 108 of the casing 104. The cap may be made of a similar rigid material to further protect the consumable material 106 from the environment.

The consumable material 106 may be a paste mass applied onto a body. In one embodiment, the paste mass is a cosmetic product, such as a deodorant pod, lipstick or sunscreen. For example, a deodorant pod can be made from a wide variety of formulas which have deodorant and/or antiperspirant properties. This may include materials that contain aluminum chlorohydrate, aluminum chloride, aluminum sulfate, and aluminum zirconium. Additional materials may be used to bind and suspend deodorant and antiperspirant materials into a solid form. Alternative formulas may be made from all-natural materials such as coconut oil and beeswax that also have deodorant and/or antiperspirant properties. As used herein, the terms "deodorant", "deodorant product", "deodorant pod" and the like may include materials with antiperspirant properties. It is noted the consumable material 106 may include various non-cosmetic materials, such as glue sticks and butter.

The casing 104 includes at least one sidewall 110 extending vertically from a base at a bottom end 114 to the top end 108. Additionally, the casing 104 defines a longitudinal axis 116 oriented from the top end 108 to the bottom end 114 and passing through the centroid of the casing cross sections.

Figure 2:
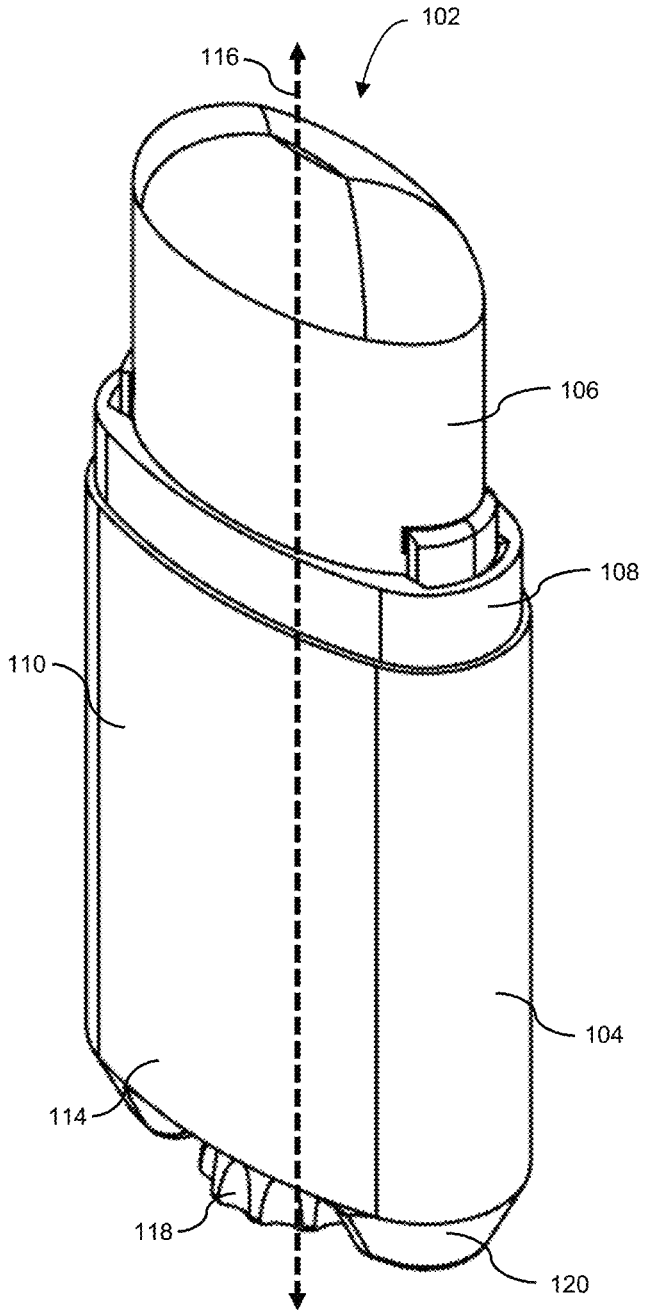
FIG. 2 shows consumable material of FIG. 1 shifted up the casing of the dispenser.

The dispenser 102 includes a knob 118 rotatably mounted at the bottom end 114 of the casing 104. As detailed below, the knob 118 is mechanically coupled to a platform carrying the consumable material 106. Rotating the knob 118 causes the platform and the consumable material 106 to move up and down the casing 104 along the longitudinal axis 116. For example, FIG. 2 shows the consumable material 106 shifted up the casing 104. The knob 118 may include ridges or other surface treatments to aid users grip the knob 118. The dispenser 102 may include protrusions 120 to help prevent the knob 118 from unintentionally turning.

Figure 3A:
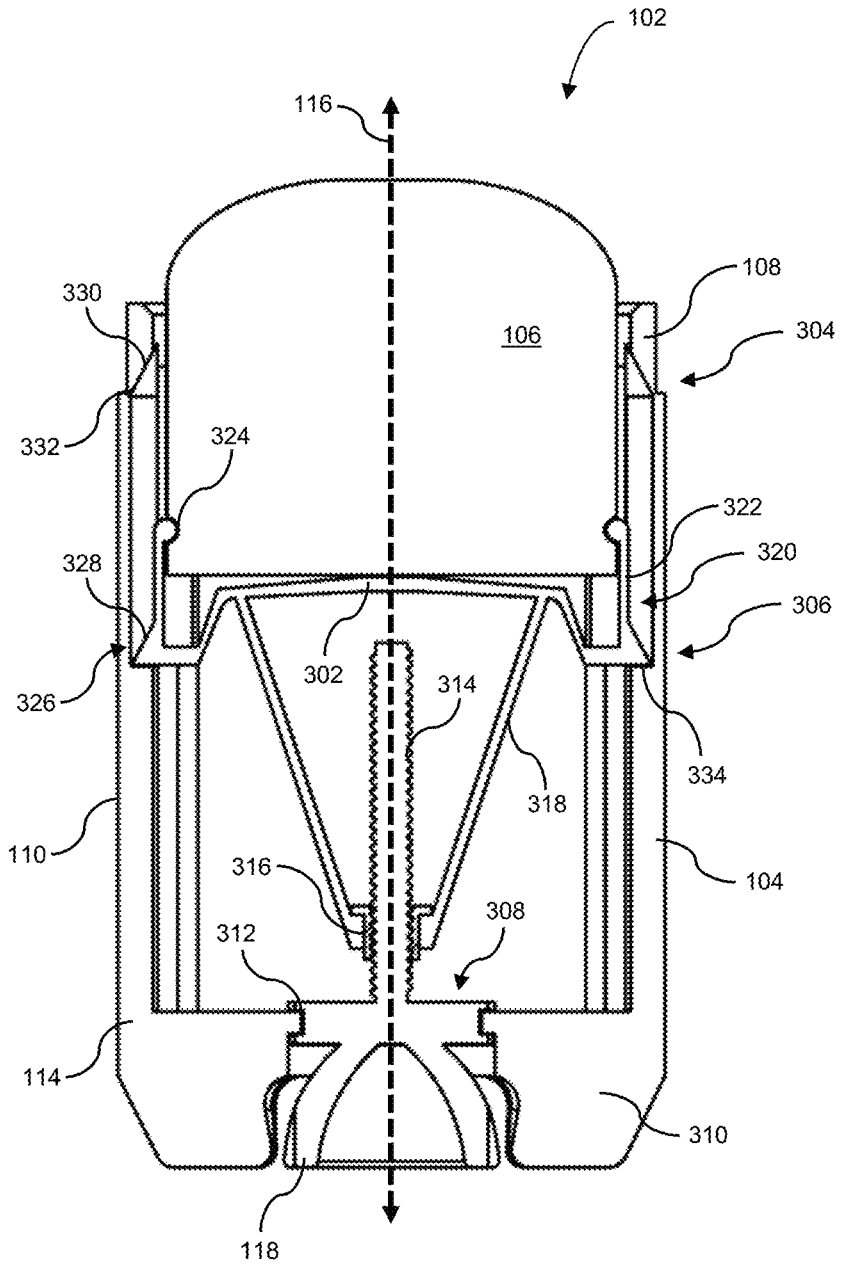
FIG. 3A shows a platform at a bottom travel position within the casing of FIG. 1.
Figure 3B:
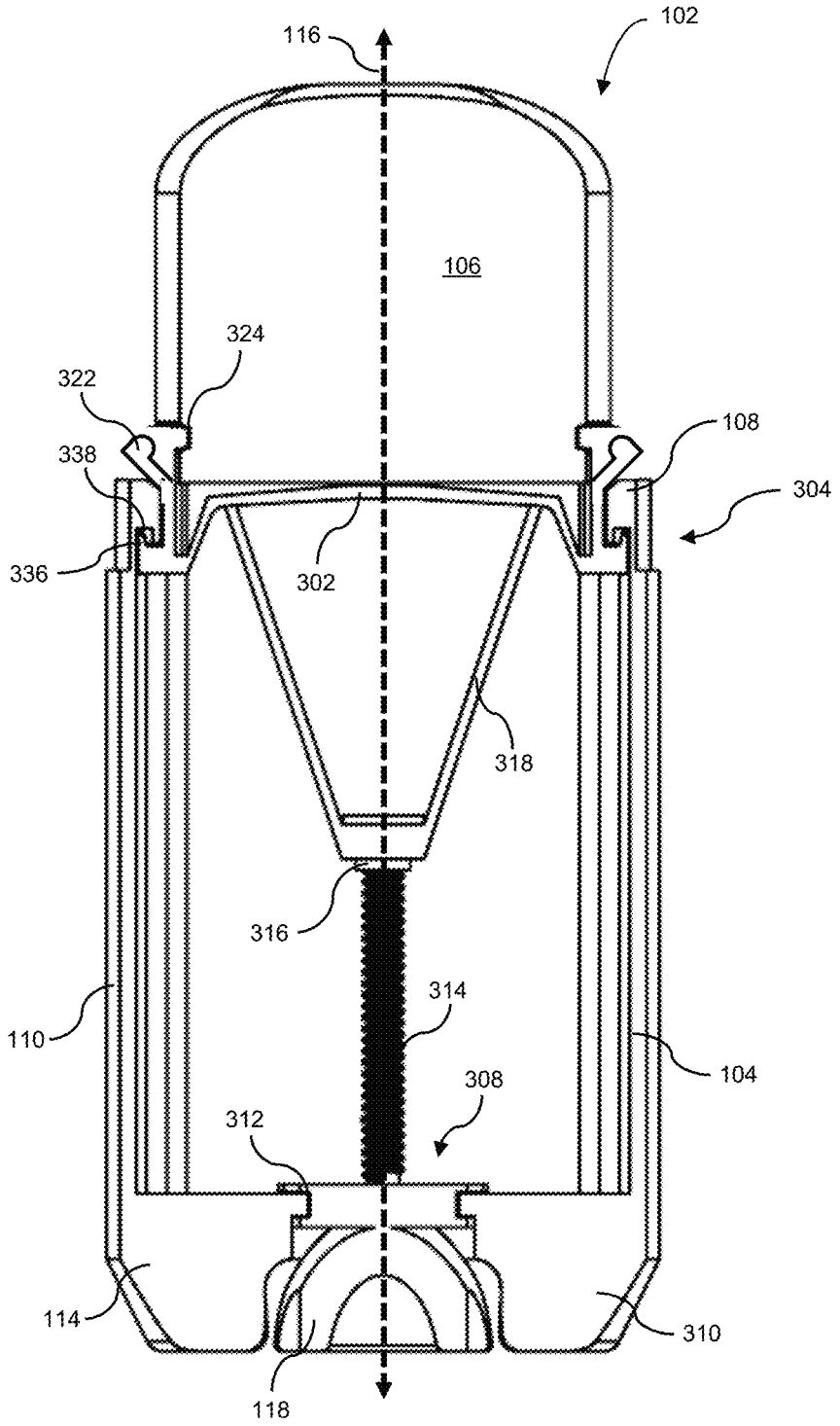
FIG. 3B shows a platform at a top travel position within the casing of FIG. 1.

FIG. 3A shows one embodiment of a platform 302 at a fully retracted position within the casing 104. FIG. 3B shows the platform 302 at a fully extended position within the casing 104. As mentioned above, the platform 302 is adapted to receive the consumable material 106. Furthermore, the platform 302 is movable along the longitudinal axis 116 in a distal direction and a proximal direction. The distal direction is from a top travel position 304 proximate the top end 108 to a bottom travel position 306. The proximal direction is from the bottom travel position 306 to the top travel position 304. In one embodiment, the bottom travel position 306 is proximate the base 310 of the dispenser 102.

Movement of the platform 302 is actuated by the knob 118 rotatably mounted at the bottom end 114 of the casing 104. In one embodiment, the knob 118 includes a circular track 312 interlocked with a base opening 308 at the bottom end 114. The knob 118 and/or base 310 may be constructed of a plastic material with enough flex to snap-fit when the knob 118 is pushed into the base opening 308.

In one embodiment, the knob 118 includes a leadscrew 314 extending toward the top end 108 of the casing 104 along the longitudinal axis 116. The dispenser 102 may include a threaded sleeve 316 connected to the platform 302. The threaded sleeve 316 is configured to mate the leadscrew 314 such that rotating the knob 118 in the first direction moves the threaded sleeve 316 longitudinally in the distal direction along the leadscrew 314 and rotating the knob in the second direction moves the threaded sleeve 314 longitudinally in the proximal direction along the leadscrew 314. The dispenser 102 may include a substantially v-shaped section 318 connected to the threaded sleeve 316 and the platform 302, such that the threaded sleeve 316 is spaced apart from the platform 302 along the longitudinal axis 116.

The casing 104 may include a lower travel limit 334 at the bottom travel position 306. In one embodiment, the lower travel limit 334 is a shelf acting as a barrier to physically prevent the retaining clip 320 from traveling past the bottom travel position 306 in the distal direction.

Figure 4:
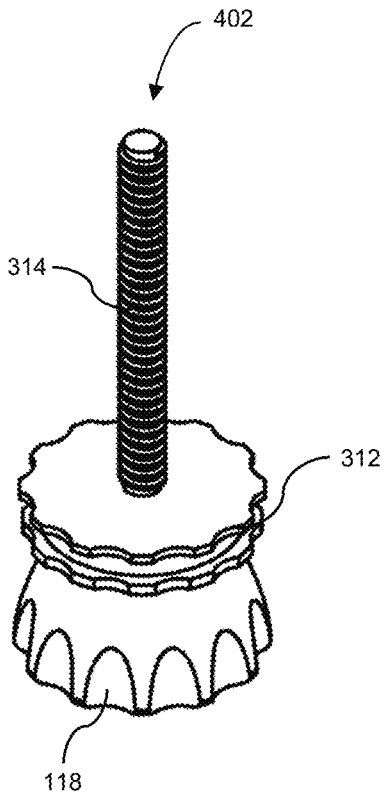
FIG. 4 illustrates a knob assembly for the dispenser of FIG. 1.

As shown in FIG. 4, a knob assembly 402 may include the knob 118, a circular track 312, and the threaded sleeve 314. In one embodiment, the knob assembly 402 is a unitary body manufactured, for example, from injection molded plastic.

Returning to FIGS. 3A and 3B, a plurality of retaining clips 320 are shown connected to the platform 302 and securing the consumable material 106 to the platform 302. The retaining clips 320 include gripping arms 322 configured to flex inwardly toward the longitudinal axis 116 and latch onto the consumable material 106 when the platform 302 is away from the top travel position 304. In this manner, the gripping arms 322 secure the consumable material 106 to the platform 302.

The gripping arms 322 are also configured to flex outwardly and away from the longitudinal axis 116 to release the consumable material 106 from the platform 302 when the platform 302 is at the top travel position 304. In one embodiment, the gripping arms 322 engage at least one channel 324 defined by the consumable material 106 when the platform 106 is positioned away from the top travel position 304. Thus, by moving the platform 302 to the top travel position 304, depleted consumable material 106 carried by the platform 302 can be replaced with new consumable material 106.

FIG. 3A shows actuation of the gripping arms 322 may be achieved by a deflecting section 326 at each retaining clip 320. The deflecting section 326 includes an inclined wall 328 sloping toward the longitudinal axis 116 along the proximal direction. The top end 108 of the casing 104 may include at least one overhang 330 extending from the sidewall 110 toward the longitudinal axis 116. When the inclined wall 328 engages the overhang 330 at a deflecting position 332, a force is exerted against the inclined wall 328 causing the gripping arm 322 to flex away from the longitudinal axis 116 and release the consumable material 106. As the inclined wall 328 travels past the deflecting position 332 and closer to the top end 108, the amount of deflection away from the longitudinal axis 116 the gripping arm 322 experiences increases.

As shown in FIG. 3B, the platform 302 may include retainers 336 configured to prevent the platform 302 from traveling in a proximal direction past the top travel position 304. In one embodiment, the retainers 336 hook an upper travel limit overhang 338 at the top end 108 to prevent further travel in the proximal direction.

The dispenser 102 disclosed herein reduces the environmental impact in comparison to single-use, disposable dispensers. The dispenser 102 does not have to be disposed once the consumable material 106 is depleted. Rather, as described above, a new stick of consumable material 106 can be secured to the platform 302 and the dispenser 102 can be reused.

Figure 5:
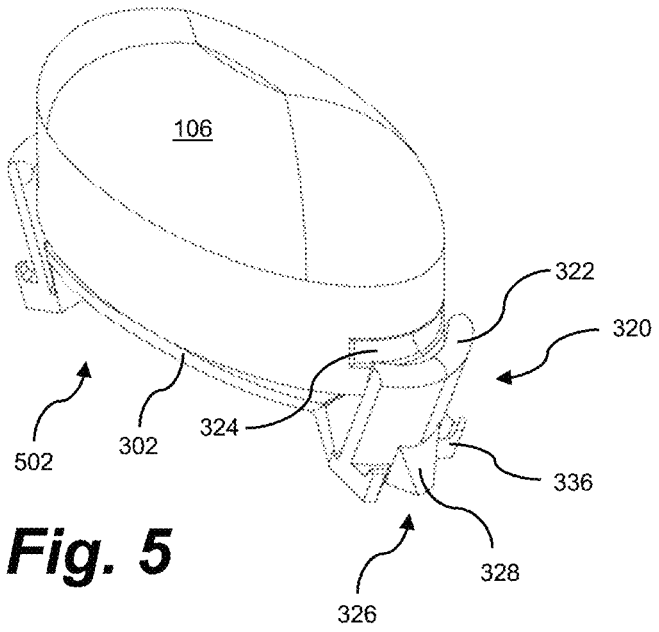
FIG. 5 shows an example carrier assembly in a deflected position for the dispenser of FIG. 1.

FIG. 5 shows an example carrier assembly 502 in the deflected position. The carrier assembly 502 includes a compliant mechanism that causes the gripping arm 322 to flex away from channels in the consumable material 106 and release the consumable material 106 from the carrier 302. In particular, the carrier assembly 502 is composed of a compliant material that flexes away from the consumable material 106 when force is exerted against the inclined wall 328 of the deflecting section 326.

The carrier assembly 502 may include retainers 336 configured to prevent the carrier assembly 502 from traveling in a proximal direction past the top travel position. In one embodiment, the retainers 336 hook an upper travel limit overhang at the top end 108 to prevent further travel in the proximal direction.

Figure 6:
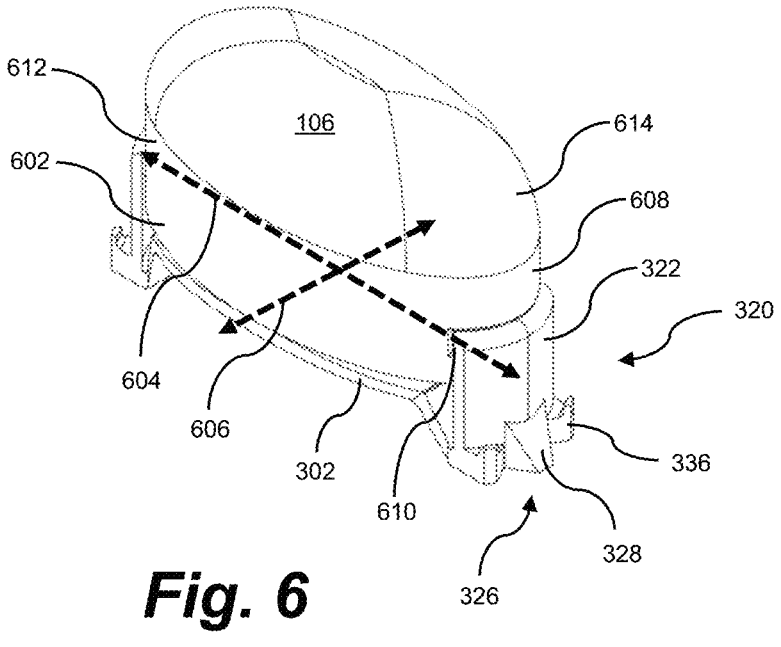
FIG. 6 shows an example carrier assembly in an engaged position for the dispenser of FIG. 1.

FIG. 6 shows the example carrier assembly 502 in the engaged position. In this position, the gripping arms 322 are flexed inwardly to engage channels 324 in the consumable material 106.

As mentioned above, in one embodiment of the present invention, consumable material 106 is a deodorant product. The deodorant product can include an elliptical base 602 defining a major axis 604 and a minor axis 606. The deodorant product can further include a cylindrical body 608 rising from the base 602 that defines a first channel 610 and a second channel 612 at opposite ends of the major axis 604. As discussed above, the first channel 610 and the second channel 612 are each configured to receive a respective gripping arm 322 from a plurality of gripping arms, and to releasably secure the deodorant product to the platform 302. The deodorant product may include a domed top 614 over the cylindrical body 608.

Figure 7:
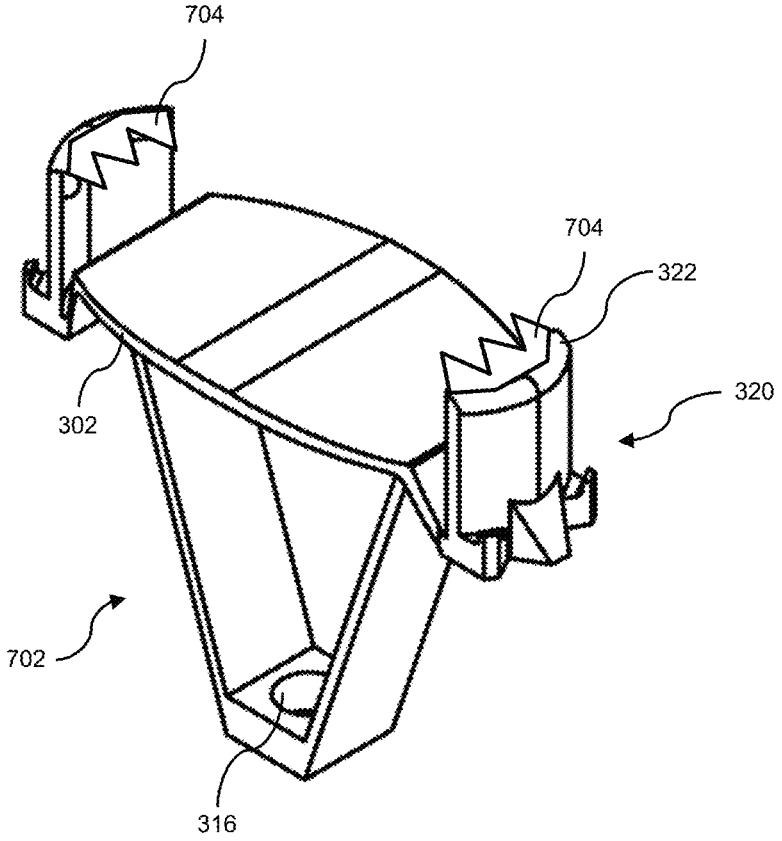
FIG. 7 shows an example carrier assembly for the dispenser of FIG. 1.

FIG. 7 shows another example carrier assembly 702 contemplated by the present invention. In this embodiment, the carrier assembly 702 is a unitary body including the carrier 302, retaining clip 320, threaded sleeve 316, and substantially v-shaped section 318. The carrier assembly 702 may be manufactured, for example, from injection molded plastic. As illustrated, the gripping arms 322 may include one or more teeth 704 configured to pierce the consumable material when the platform is positioned away from the top travel position.

Figure 8:
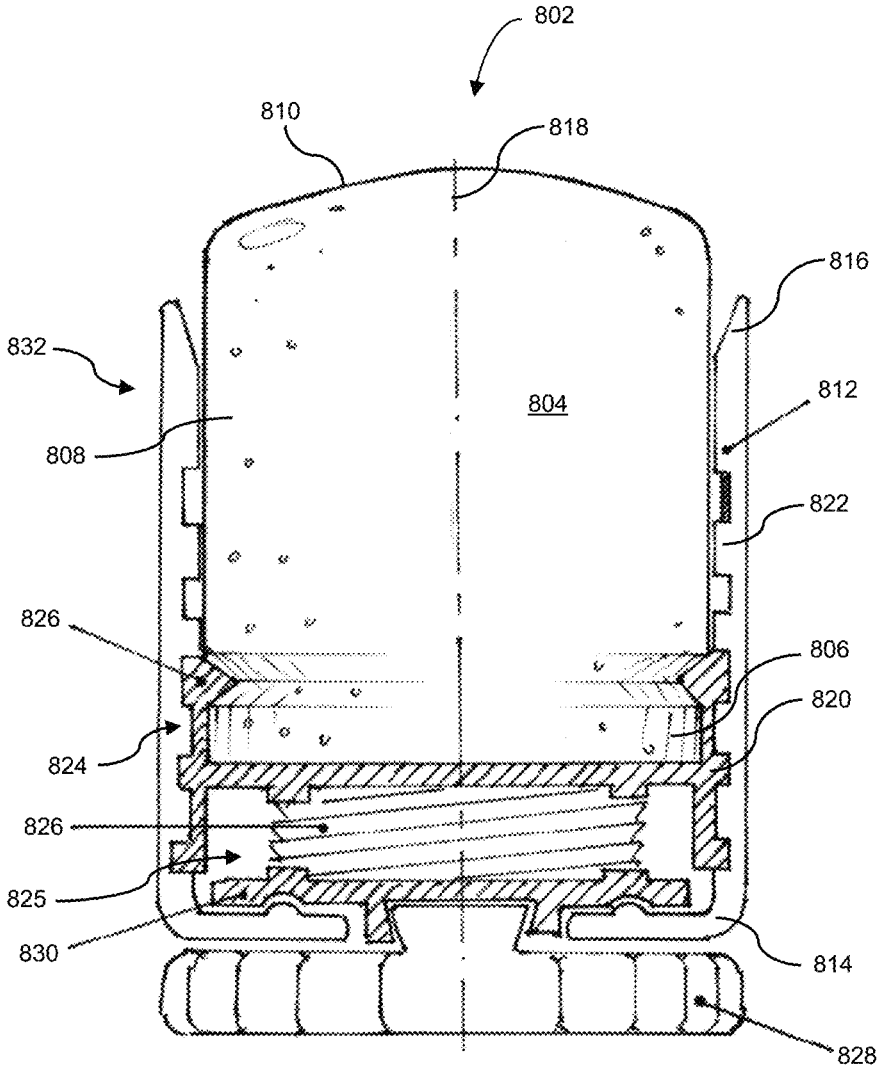
FIG. 8 shows another embodiment of a refillable dispenser contemplated by the present invention.

FIG. 8 shows another embodiment of a refillable dispenser or applicator 802 contemplated by the present invention. The dispenser 802 includes consumable material 804 with a round base 806, a body 808 rising from the base 806, and a domed top 810 over the body 808.

The dispenser 802 further includes a casing 812 extending from a bottom end 814 to a top end 816. The casing 812 defines a longitudinal axis 818. A platform 820 positioned within the casing 812 is configured to receive the consumable material 804. The platform 820 engages a threaded inner wall 822 and is rotatable about the longitudinal axis 818. As the platform 820 rotates within the threaded inner wall 822, the platform 820 threads along the longitudinal axis 818. The threading action causes the platform 820 to travel in a distal direction or a proximal direction along the longitudinal axis 818, corresponding to the direction of rotation.

An elevator assembly 825 is operably coupled to the platform 820 and a knob 828 such that rotation of the knob 828 about the longitudinal axis 818 causes a corresponding rotation of the platform 820. In one embodiment, the elevator assembly 825 includes an elevator base 830 configured to snap-fit and mate with the knob 828. The elevator assembly 825 includes telescoping arms 826 made from a compliant material such that the height of the telescoping arms 826 along the longitudinal axis 818 can vary.

Figure 9:
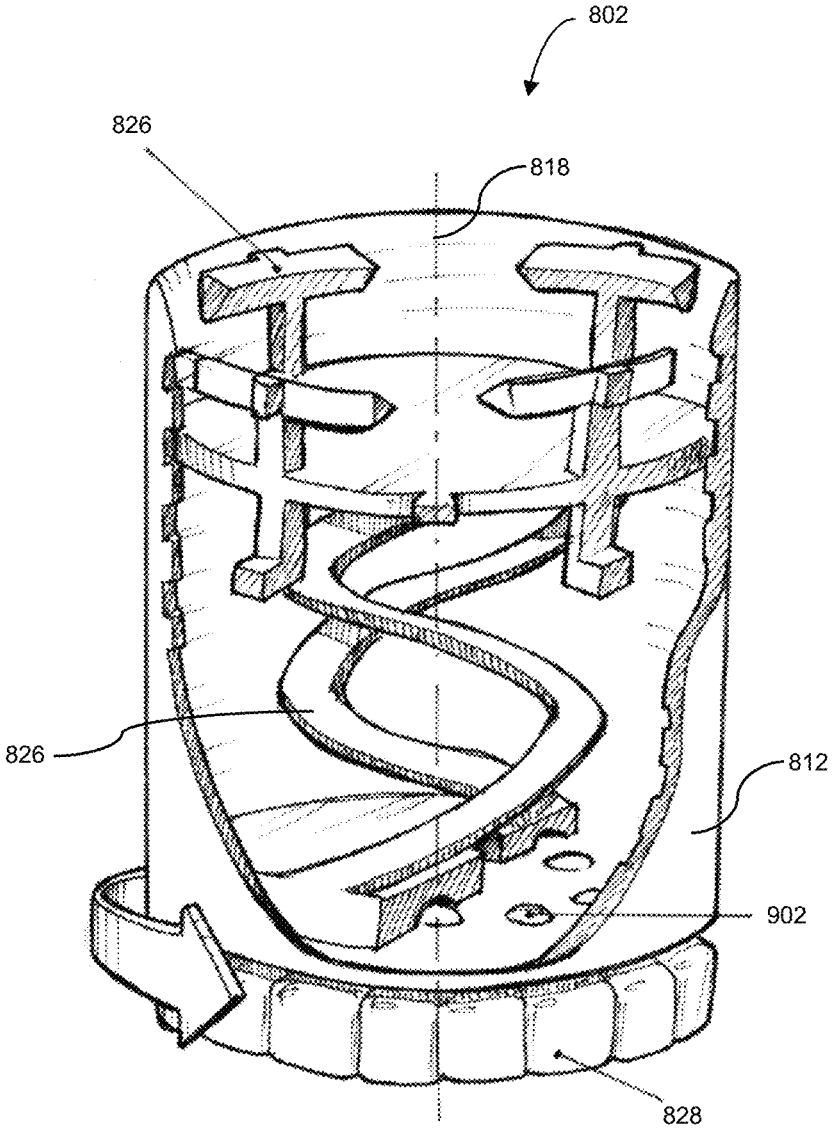
FIG. 9 shows helical telescoping arms extending as the platform travels up the casing.

As shown in FIG. 9, as the platform travels up the casing 812, the telescoping arms 826 extend from a compressed height to an extended height. In one embodiment, the telescoping arms 826 are made from a compliant, helical-shaped plastic.

In one embodiment, the casing 812 and knob 828 include a plurality of detents 902 providing haptic feedback to a user turning the knob 828. As the user turns the knob 828, the detents 902 arrest rotation at fixed angular distances to divide knob rotation into discrete increments. It is contemplated the detents 902 may be, for example, mechanical or magnetic detents.

Returning to FIG. 8, a plurality of retaining clips 824 connected to the platform 820 secure the consumable material 804 when the platform 820 is positioned away from the top travel position 832. In particular, each of the retaining clips 824 includes a gripping arm 826 configured to flex toward the longitudinal axis 818 and engage the consumable material 804 when the platform 820 is away from the top travel position 832 such that the consumable material is secured to the platform 820.

Figure 10:
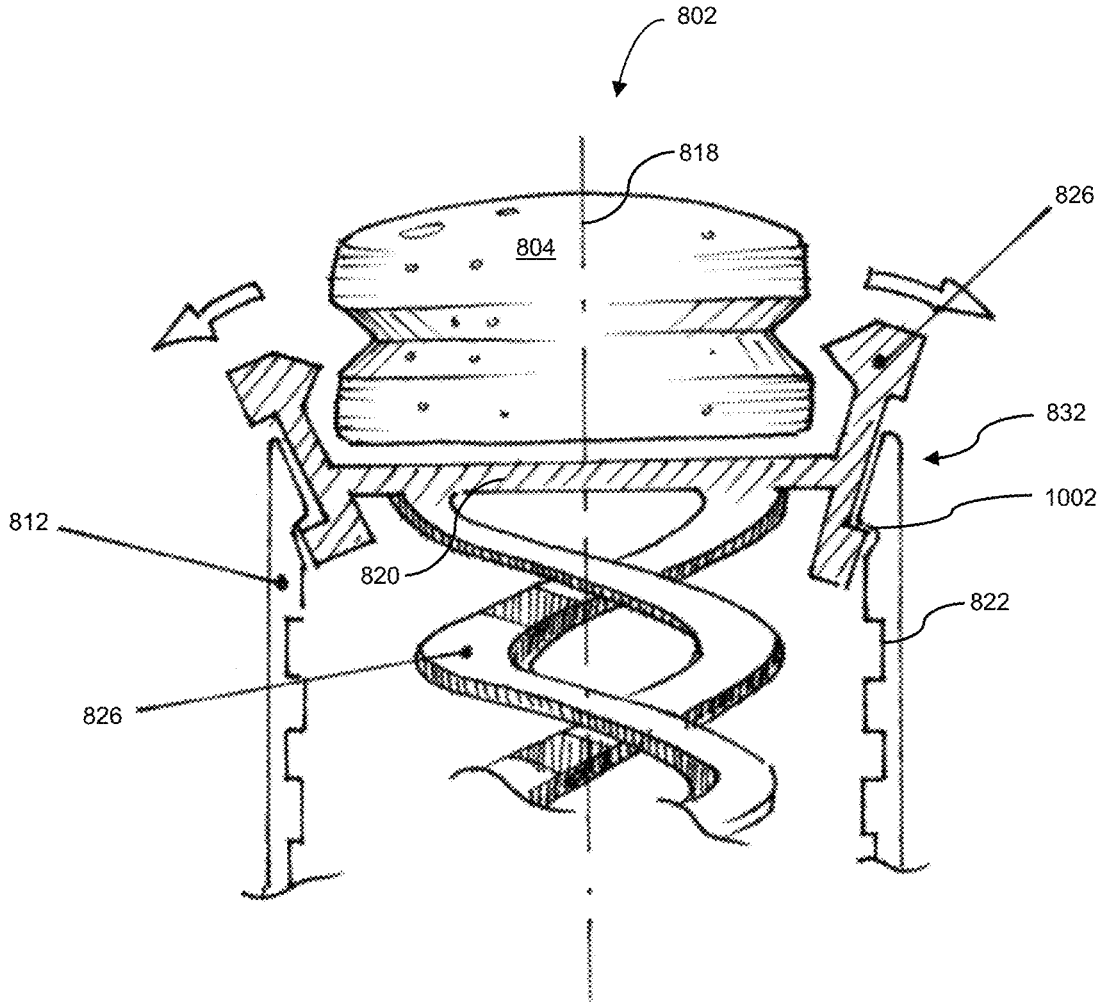
FIG. 10 shows the gripping arms flexing away from the longitudinal axis and releasing the consumable material from the platform when the platform is at the top travel position.

As shown in FIG. 10, the gripping arms 826 are configured to flex away from the longitudinal axis 818 and release the consumable material 804 from the platform 820 when the platform 820 is at the top travel position. In this embodiment, the threaded inner wall 822 includes sloped thread section 1002 proximate the top travel position 823 such that the gripping arms 826 flex away from the longitudinal axis 818 as the platform 820 is threaded in the sloped thread section 1002.

Thus, upon sufficient depletion of the consumable material 804, the remaining consumable material 804 can be removed from the dispenser 802 and a new pod of consumable material 804 can be secured onto the platform 820. In particular, the new pod is seated on the platform 820 and the knob 828 is rotated so that the platform 820 lowers along the longitudinal axis 818. As the platform 820 lowers, the gripping arms 826 flex toward the longitudinal axis 818 and engage the consumable material 804, thereby securing the consumable material 804 to the platform 820.

As mentioned above, in one embodiment of the present invention, consumable material 106 is a deodorant product. The deodorant product can include an elliptical base 602 defining a major axis 604 and a minor axis 606. The deodorant product can further include a cylindrical body 608 rising from the base 602 that defines a first channel 610 and a second channel 612 at opposite ends of the major axis 604. As discussed above, the first channel 610 and the second channel 612 are each configured to receive a respective gripping arm 322 from a plurality of gripping arms, and to releasably secure the deodorant product to the platform 302. The deodorant product may include a domed top 614 over the cylindrical body 608.

While the exemplary embodiments to the invention has been described, it will be understood that those skilled in the art, both now and in the future, may make various improvements and enhancements which fall within the scope of the appended claims.

What is claimed is:

1. A dispenser for dispensing consumable material, the dispenser comprising:

a casing extending from a bottom end to a top end, the casing defining a longitudinal axis;

a platform positioned within the casing, the platform adapted to receive the consumable material, the platform movable along the longitudinal axis in a distal direction from a top travel position proximate the top end to a bottom travel position and a proximal direction from the bottom travel position to the top travel position;

a plurality of retaining clips connected to the platform, each of the retaining clips includes a gripping arm configured to flex toward the longitudinal axis and engage the consumable material when the platform is away from the top travel position such that the consumable material is secured to the platform, the gripping arm configured to flex away from the longitudinal axis and release the consumable material from the platform when the platform is at the top travel position;

a knob rotatably mounted at the bottom end of the casing, the knob mechanically coupled to the platform such that rotating the knob in a first direction moves the platform in the distal direction and rotating the knob in a second direction moves the platform in the proximal direction.

2. The dispenser of claim 1, wherein the gripping arm is configured to engage one or more channels in the consumable material when the platform is positioned away from the top travel position.

3. The dispenser of claim 1, wherein the gripping arm includes one or more teeth configured to pierce the consumable material when the platform is positioned away from the top travel position.

4. The dispenser of claim 1, further comprising:

wherein the top end of the casing includes at least one overhang extending toward the longitudinal axis at the top travel position;

wherein each of the retaining clips includes a deflecting section, the deflecting section including an inclined wall sloping toward the longitudinal axis along the proximal direction, the inclined wall configured to contact the overhang at a deflecting position; and wherein the gripping arm flexes away from the longitudinal axis as the inclined wall engages the overhang and moves closer to the top end of the casing from the deflecting position.

5. The dispenser of claim 1, further comprising:

a threaded sleeve connected to the platform; and wherein the knob includes a leadscrew extending toward the top end of the casing to the knob along the longitudinal axis, the leadscrew configured to mate the threaded sleeve such that rotating the knob in the first direction moves the threaded sleeve in the distal direction along the leadscrew and rotating the knob in the second direction moves the threaded sleeve in the proximal direction along the leadscrew.

6. The dispenser of claim 5, further comprising a substantially v-shaped section connected to the threaded sleeve and the platform such that the threaded sleeve is spaced apart from the platform along the longitudinal axis.

7. The dispenser of claim 1, wherein each of the retaining clips includes at least one retainer to prevent the platform from traveling beyond the top travel position.

8. The dispenser of claim 1, further comprising:

a telescoping elevator coupled to the platform and the knob, the telescoping elevator transferring rational motion from the knob to the platform; and wherein the casing includes a threaded inner wall; and wherein an outer edge of the platform rotatably engages the threaded inner wall such that rotating the knob in the first direction moves the platform in the distal direction along the threaded inner wall and rotating the knob in the second direction moves the platform in the proximal direction along the threaded inner wall.

9. A refillable deodorant applicator comprising:

a deodorant product;

a cylindrical casing enclosing the deodorant product, the cylindrical casing including a base and a sidewall extending from the base to a top end, the casing defining a longitudinal axis;

a platform positioned within the casing, the platform adapted to receive the deodorant product, the platform movable along the longitudinal axis in a distal direction from a top travel position proximate the top end to a bottom travel position and a proximal direction from the bottom travel position to the top travel position;

a plurality of retaining clips connected to the platform, each of the retaining clips includes a gripping arm from a plurality of gripping arms, each of the gripping arms configured to flex toward the longitudinal axis and engage the deodorant product when the platform is away from the top travel position such that the deodorant product is secured to the platform, each of the gripping arms configured to flex away from the longitudinal axis and release the deodorant product from the platform when the platform is at the top travel position;

a knob rotatably mounted at the base, the knob mechanically coupled to the platform such that rotating the knob in a first direction moves the platform in the distal direction and rotating the knob in a second direction moves the platform in the proximal direction.

10. The refillable deodorant applicator of claim 9, wherein each of the gripping arms is configured to engage one or more channels in the deodorant product when the platform is positioned away from the top travel position.

11. The refillable deodorant applicator of claim 9, wherein each of the gripping arms includes one or more teeth configured to pierce the consumable material when the platform is positioned away from the top travel position.

12. The refillable deodorant applicator of claim 9, further comprising:

wherein the top end of the casing includes at least one overhang extending from the sidewall toward the longitudinal axis at the top travel position;

wherein each of the retaining clips includes a deflecting section, the deflecting section including an inclined wall sloping toward the longitudinal axis along the proximal direction, the inclined wall configured to contact the overhang at a deflecting position; and wherein the each of the gripping arms is configured to flex away from the longitudinal axis as the inclined wall engages the overhang and moves closer to the top end of the casing from the deflecting position.

13. The refillable deodorant applicator of claim 9, further comprising:

a leadscrew extending from the knob toward the top end of the casing along the longitudinal axis; and a threaded sleeve connected to the platform and configured to mate the leadscrew such that rotating the knob in the first direction moves the threaded sleeve in the distal direction along the leadscrew and rotating the knob in the second direction moves the threaded sleeve in the proximal direction along the leadscrew.

14. The refillable deodorant applicator of claim 13, further comprising a substantially v-shaped section connected to the threaded sleeve and the platform such that the threaded sleeve is spaced apart from the platform along the longitudinal axis.

15. The refillable deodorant applicator of claim 9, further comprising a stop section connected to the platform, the stop section configured to stop the platform from traveling beyond the top travel position.

16. The refillable deodorant applicator of claim 9, wherein the deodorant product includes:

an elliptical base defining a major axis and a minor axis; and a cylindrical body rising from the base, the cylindrical body defining a first channel and a second channel at opposite ends of the major axis, the first channel and the second channel each configured to receive a respective gripping arm from the plurality of gripping arms and to releasably secure the deodorant product to the platform.

17. The refillable deodorant applicator of claim 16, wherein the deodorant product includes a domed top over the cylindrical body.

18. The refillable deodorant applicator of claim 9, further comprising:

a telescoping elevator coupled to the platform and the knob, the telescoping elevator transferring rational motion from the knob to the platform; and wherein the casing includes a threaded inner wall, the threaded inner wall includes sloped thread section proximate the top travel position such that the gripping arms flex away from the longitudinal axis as the platform is threaded in the sloped thread section; and wherein an outer edge of the platform rotatably engages the threaded inner wall such that rotating the knob in the first direction moves the platform in the distal direction along the threaded inner wall and rotating the knob in the second direction moves the platform in the proximal direction along the threaded inner wall.

19. A deodorant pod comprising:

an elliptical base defining a major axis and a minor axis;

a cylindrical body rising from the base, the cylindrical body defining a first channel and a second channel at opposite ends of the major axis, the first channel and the second channel each configured to receive a respective gripping arm and to releasably secure the deodorant pod to a dispensing platform.

20. The deodorant pod of claim 19, further comprising a domed top over the cylindrical body.

* * * * *